US006997248B2

(12) United States Patent
Shabtay et al.

(10) Patent No.: US 6,997,248 B2
(45) Date of Patent: Feb. 14, 2006

(54) HIGH PRESSURE HIGH TEMPERATURE CHARGE AIR COOLER

(75) Inventors: Yoram Leon Shabtay, Prospect Heights, IL (US); John C. Hipchen, Palatine, IL (US)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 10/848,325

(22) Filed: May 19, 2004

(65) Prior Publication Data

US 2005/0257922 A1 Nov. 24, 2005

(51) Int. Cl.
*F28D 1/053* (2006.01)

(52) U.S. Cl. ..... 165/153; 165/173; 165/910

(58) Field of Classification Search ..... 165/151, 165/153, 172, 173, 910
See application file for complete search history.

(56) References Cited

U.S. PATENT DOCUMENTS

| | | | | |
|---|---|---|---|---|
| 1,739,672 | A * | 12/1929 | Higgins | 165/151 |
| 2,006,649 | A * | 4/1935 | Modine | 165/151 |
| 3,648,768 | A * | 3/1972 | Scholl | 165/173 |
| 4,125,280 | A * | 11/1978 | Kuzel | 165/148 |
| 4,664,181 | A * | 5/1987 | Sumberg | 165/104.13 |
| 4,715,437 | A * | 12/1987 | Tanaka et al. | 165/151 |
| 4,740,344 | A * | 4/1988 | Wollbeck et al. | 165/148 |
| 5,277,247 | A * | 1/1994 | Cameron | 165/910 |
| 5,320,165 | A | 6/1994 | Hughes | 165/153 |
| 5,555,933 | A | 9/1996 | Darragh et al. | 165/166 |
| 5,791,404 | A * | 8/1998 | Bailey et al. | 165/910 |
| 6,125,925 | A * | 10/2000 | Obosu et al. | 165/151 |
| 6,182,743 | B1 | 2/2001 | Bennett et al. | 165/133 |
| 6,364,008 | B1 * | 4/2002 | Mannoni et al. | 165/172 |
| 6,374,911 | B1 | 4/2002 | Olson et al. | 165/173 |
| 6,470,964 | B1 | 10/2002 | Nakado et al. | 165/177 |
| 2001/0027857 | A1 | 10/2001 | Emrich et al. | 165/109.1 |
| 2002/0125002 | A1 | 9/2002 | Nakado et al. | 165/172 |
| 2003/0066633 | A1 | 4/2003 | Lee et al. | 165/144 |
| 2003/0102116 | A1 | 6/2003 | Memory et al. | 165/173 |

FOREIGN PATENT DOCUMENTS

| | | |
|---|---|---|
| CA | 2237365 | 5/1999 |
| EP | 0805331 | 11/1997 |
| JP | 2000-39293 | 2/2000 |
| JP | 2001-289576 | 10/2001 |
| JP | 2001-330390 | 11/2001 |
| WO | WO 2004/005828 | 1/2004 |

* cited by examiner

*Primary Examiner*—Teresa J. Walberg
(74) *Attorney, Agent, or Firm*—Winston & Strawn LLP

(57) ABSTRACT

A charge air cooler formed of copper or a copper alloy for withstanding high temperatures and high pressures is described. The charge air cooler is made to withstand temperatures over about 300° C. and pressures greater than about 40 bars in one embodiment, and temperatures over about 600° C. and pressures greater than 40 bars in additional embodiments. The heat transfer tubes are connected to manifolds at either end. The manifolds are preferably formed of copper or copper alloy with the tubes mechanically joined thereto. In one embodiment, the tubes are arranged in alternating angles with respect to each other. In a preferred embodiment, the tubes are arranged in offset alternating angles with respect to each other.

18 Claims, 4 Drawing Sheets

HIGH PRESSURE HIGH TEMPERATURE CHARGE AIR COOLER

FIELD OF INVENTION

The present invention relates to heat exchangers, and more specifically to charge air coolers. Charge air coolers are used with internal combustion engines and must be able to withstand high pressures and high temperatures. The invention may be used for applications requiring high temperature and high pressure charge air coolers, such as in automotive, off-road, industrial, and power generation equipment.

BACKGROUND OF THE INVENTION

A heat exchanger is an apparatus for exchanging heat between a fluid, usually one at a high temperature and one at a low temperature. Charge air coolers are specific heat exchangers that are used in particularly stressful environments, such as on internal combustion engines with turbochargers or superchargers.

A turbocharger includes a turbine wheel that is driven by exhaust gases from an engine, and which drives a rotary compressor. A supercharger includes a rotary compressor which is driven by an engine or by a motor that is powered by the engine. Both devices permit an increase in power without adding additional cylinders or substantially increasing the size of the engine. The rotary compressors compress the air entering the engine to permit more air and fuel to enter the cylinders. Compressing the air raises the pressure in the system, which in turn raises the temperature.

When the air is compressed by the turbocharger or supercharger, it is also heated, which causes its density to decrease. In a charge air cooler, the hot combustion air from the turbocharger or supercharger passes through the cooler and into the engine. Ambient air also passes through the charge air cooler separately from the combustion air—often blown across the outside of the air cooler—and acts as the cooling fluid in the heat exchange process. By cooling the combustion air prior to sending it into the engine, the density of the air increases which permits more air to enter the engine and increases the power and efficiency of the engine.

Charge air coolers are not limited to use with turbocharged or supercharged engines, but may also be used with other engines where the pressure and temperature are elevated, such as diesel engines. While an automotive engine is one application for the charge air cooler, it also can be used in other types of engines.

Currently, charge air coolers are typically made of aluminum and operate at temperatures below about 250° C. Newer engines are being designed to improve efficiency and decrease emissions by increasing the boost pressure thus the new charge air coolers will be operating at temperatures of 250° C.–300° C. and higher. The yield strength of aluminum drops quickly as temperatures increase above 150° C., and typically becomes too weak for use in these applications at about 250° C. One multi-tube heat exchanger is disclosed in EP0805331 where the tubes are formed of round aluminum or aluminum alloy. Such a construction will most likely fail at high temperatures by rupture since the aluminum tubes will be weakened by the high heat conditions.

Charge air coolers currently operate at pressures of less than about 3 bars and use flat, wide tubes to transport charge air from the turbocharger compressor. The flat tubes contain internal fins brazed to the inner walls of the tubes to facilitate heat transfer. The internal fins also act as support for the tube under higher pressures to prevent the tube from becoming round. Any flaws or inconsistencies in the brazed joined within the tube will result in failures as pressures near 3 bars. To meet future emission guidelines, newer charge air coolers will be required to operate at pressures of from about 3 to 10 bars and even above 10 bars up to about 40 bars. Current designs of charge air coolers would require heavy gauge materials to operate at these pressures. The heavier gauge materials increase the weight and cost of the components and also increase the pressure drop of the air traveling through the tubes. The use of such heavy gauge materials is unacceptable for these reasons so alternative constructions need to be considered.

An example of a heat exchanger for use in high pressure refrigeration systems is disclosed in US 2003/0102116. The heat exchanger in this application is made of aluminum, and as such, it will not withstand temperatures above 250° C. at temperatures necessary for use in a charge air cooler, due to the low strength of aluminum at such temperatures.

U.S. Pat. No. 6,470,964 discloses a heat exchanger tube for use in the condenser of an air conditioner or refrigerator. The tube is capable of withstanding moderately high operating pressures by virtue of connected depressions on opposite sides of a flat tube. At pressures of about 40 bars, it is unlikely that the tube will maintain its flat shape.

U.S. Pat. No. 6,182,743 discloses a heat exchanger tube having an internal surface that is configured to enhance the heat transfer performance of the tube. The internal enhancement has a plurality of polyhedrons extending from the inner wall of the tubing. The polyhedrons have first and second planar faces disposed substantially parallel to the polyhedral axis. The polyhedrons have third and fourth faces disposed at an angle oblique to the longitudinal axis of the tube. The resulting surface increases the internal surface area of the tube and the turbulence characteristics of the surface, and thus, increases the heat transfer performance of the tube. The high pressure capabilities of such tubes are not discussed. This tube is used in air conditioning and refrigeration systems units having refrigerant flowing inside these tubes. The refrigerant changes phase from gas to liquid in the condenser heat exchanger part of the system and from liquid to gas in the evaporator heat exchanger part of the system.

Due to the low temperatures required to operate with aluminum, some applications use a pre-cooler to cool the air in separate stages. The hot air is pre-cooled in the first stage and later cooled in the aluminum charge air cooler. Such a system is more complex than the present invention and adds to the weight, size, and cost of the system.

While other metals and metal alloys can be considered for high pressure, high temperature applications, most do not have the high heat transfer properties of copper or copper alloys. While it is known that heat exchanger tubes made of steel, stainless steel or nickel base alloys have much greater temperature and pressure resistance, such tubes are more expensive than copper and are not as efficient or effective in transferring heat. In addition, such other metals and alloys would add significantly to the weight and cost of the system.

Accordingly, there is a need for an improved charge air cooler that is capable of withstanding high pressures and high temperatures, as currently used and as expected in the future. The present invention now provides an improved construction for use in such applications.

SUMMARY OF THE INVENTION

The invention relates to a charge air cooler for operating at pressures greater than about 3 bars and temperatures up to and in some cases even greater than about 300° C. The charge air cooler includes heat exchange tubes formed of copper or a copper alloy that have substantially round cross-sections and are configured in rows. In operation, a first gas passes through the tubes and a second gas flowing over the surface of the tubes. Some of the rows are arranged such that the gas flowing over the tubes must change directions as it continues to flow past the tubes. Each row of tubes forms an angle of about 10 to about 30 degrees with respect to a horizontal center line. The tubes are connected at each end to manifolds which are preferably formed of copper, a copper alloy or stainless steel. The tubes are in fluid communication with the manifolds. The gas flowing through the tubes is cooled by the gas flowing over the outside of the tubes.

Additional optional features of the tubes include internal grooves to enhance heat transfer that extend lengthwise along the tubes and fins on the outside surface of the tubes. In a preferred embodiment, the heat exchange tubes are mechanically connected to the manifolds without allowing appreciable loss or escape of the gas from the tubes.

BRIEF DESCRIPTION OF THE DRAWINGS

The invention will be better understood in relation to the attached drawings illustrating preferred embodiments, wherein.

DETAILED DESCRIPTION OF THE PREFERRED EMBODIMENTS

Figure 1:
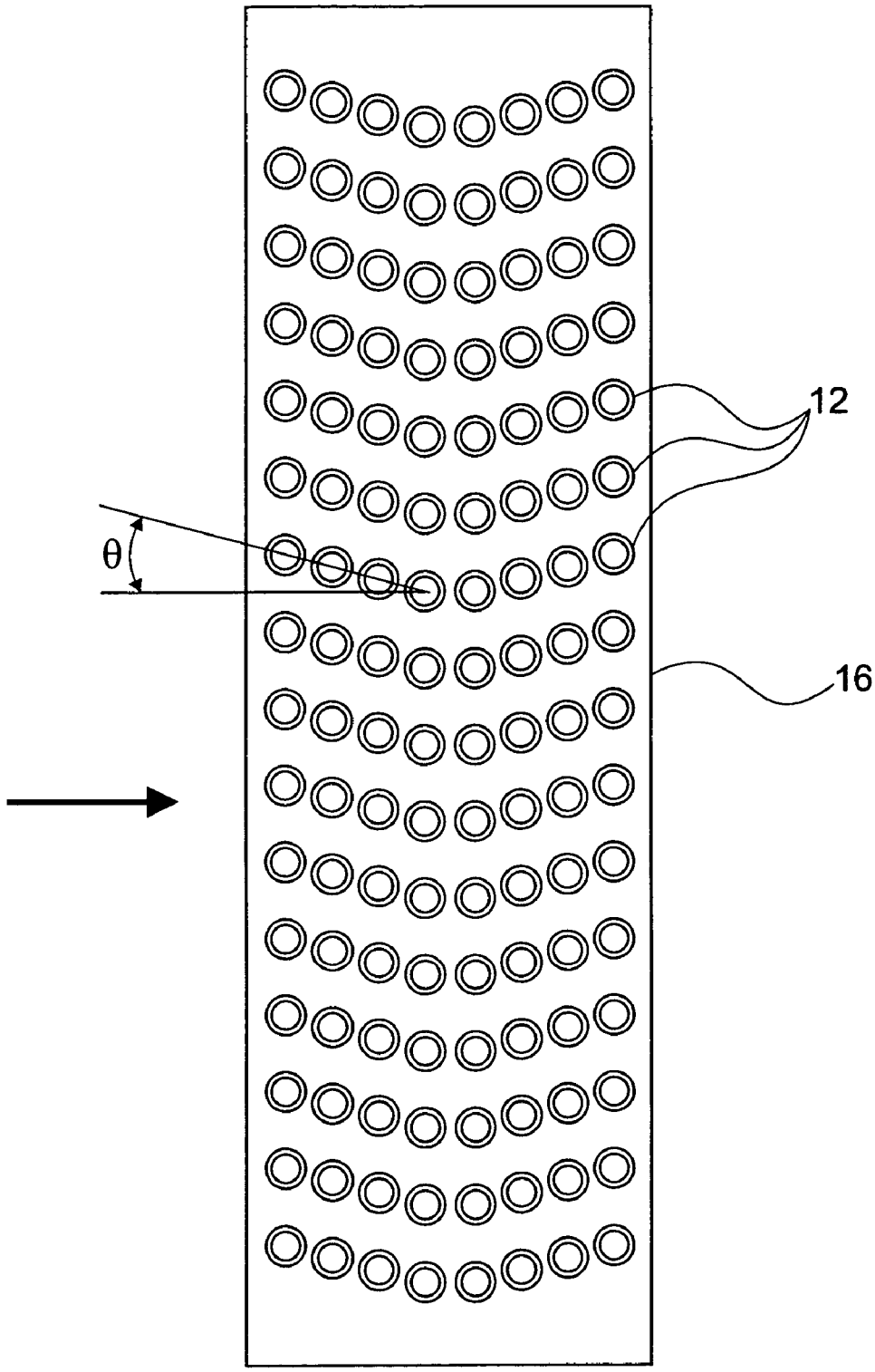
FIG. 1 shows a cross-section of the charge air cooler with the tubes in an arrangement according to one embodiment of the invention.

While some charge air coolers use water or other liquids to cool incoming air, the term "charge air cooler," as used in the present invention, refers to an application that uses air at a lower temperature to cool air at a higher temperature. Generally, the air inside the tubes of the charge air cooler is at a higher temperature than the air that flows along the outside surface of the tubes. One source of the lower temperature air is ambient or outside air.

The term "substantially round" to describe the preferred cross section of the tubes of the invention means that the tube cross section is as close to round as possible and within a tolerance of +10%. The round cross section of a cylindrical tube is preferred for optimum pressure bearing capabilities.

It has been found that tubes and manifolds formed from copper or copper alloys or stainless steel can withstand operating temperatures above about 250° C. and up to about 300° C. without significant loss of strength, due to the fact that copper has outstanding heat transfer properties. Round cross section (cylindrical) tubes and manifolds have been found to withstand pressures greater than about 10 bars and up to about 40 bars, as opposed to the flat tubes used in the prior art that will not maintain their shapes at such high pressures. To improve the heat transfer efficiency of the round tubes, internal grooves may be added while having minimal affect on the flow of the internal compressed air. The grooves permit a low internal pressure drop while improving heat transfer efficiency over tubes with smooth walls. The manifolds or tanks having a cylindrical shape are capable of resisting high internal operating pressures, while maintaining relatively thin wall thicknesses.

Inner grooves may be provided in this tube, if desired. These optional inner grooves are disclosed in detail in U.S. Pat. No. 6,182,743, the entire content of which is expressly incorporated herein, and may have any configuration known to those of ordinary skill in the art. They may run lengthwise along the tube, or preferably, may follow a helical pattern to further enhance heat transfer by repeatedly moving the air from the back of the tubes to the front. Additional configurations that may be used include polyhedral patterns described in the '743 patent. The grooved surface increases the surface area of the tubes to increase the contact area between the compressed air and the tube and enhances heat transfer. The tubes can be of various sizes depending on the application. Tubes may be about 3 mm OD to about 15 mm OD. In one embodiment, a typical tube is about 7 mm OD and in another embodiment the tube is about 9 mm OD.

Copper tubes having a helical groove are commercially available from Outokumpu Copper Franklin, Inc. of Franklin, Ky. In one embodiment, the tubes are arranged in groups of four arranged linearly at gaps of about 2 mm with each row of tubes placed at angles of 20 degrees. Copper manifolds may be used with nominal diameters of about 101.6 mm (about 4 inches). Flat louvered fins may be added to the tubes for additional heat transfer at about 10 fins per inch.

FIG. 1 shows a cross-section of the tube arrangement between the manifolds of the charge air cooler. The external, ambient air flows between the tubes from the left side of the figure in the direction of the arrows to cool the compressed air within the tubes 12. The pattern of the tube arrangement permits the ambient air to penetrate deep into the core matrix. The large temperature difference between the ambient air and the tube surface increases the heat flux and the efficiency of the heat exchanger. The tubes 12 are joined to the manifold 16 at each end.

To enhance the efficiency of the heat transfer of the charge air cooler of the present invention, the tubes are arranged geometrically to maximize the surface contact of the incoming ambient air with the outer surfaces of the tubes. The tubes are arranged at an angle (shown in FIGS. 1–2 as θ) with respect to the incoming airflow. Preferably, the tubes are arranged symmetrically with respect to the center of the manifold, such that the first half of each row of tubes is a mirror image of the second half, as shown in FIG. 1. The angle between the tube rows will cause the incoming ambient air to touch the side of all tubes in its path and the small gap between the individual tubes will increase this contact since a small amount of air will pass between the tubes. The air that flows between the angled tube rows will remain cooler all the way to the center of the core. This cooler air will now be directed towards the remaining tubes that have an opposite angle to the first half of the core. This will cause the second half of the core to be also exposed to cooler air similar to the first half. This introduction of cooler air into the middle of the core has an effect similar to doubling the frontal surface area of the heat exchanger. The larger temperature difference that remains between the charged air in the tubes and the ambient air throughout the core, not only at the ambient air entrance to the core, increases the efficiency of the heat exchanger. In a standard staggered offset tube arrangement, without the angle with respect to the incoming air, the air warms up as it travels through the core. The air entering the core heats up quickly and by the time it is traveling through the center of the core, it is has warmed up leaving only a small temperature gradient with the charged air in the tubes. The heat transfer is not as efficient as with the present arrangement since heat flux is directly proportional to temperature differential.

Of course, variations on this arrangement are also within the scope of the invention, such as having the tubes in three separate groups, rather than two as shown in the drawings. The first group could be angled down, the second group angled up, and the third group angled down again. This arrangement would maintain the beneficial effects of the present invention on the efficiency of the system.

In a standard in-line tube arrangement, as with the present invention, a stream of colder air travels between the tube rows. This colder air is not, however, directed against the other tubes down its path and is discarded at the core exit. The present invention directs this colder air stream to hit the tubes once the angle changes.

Figure 2:
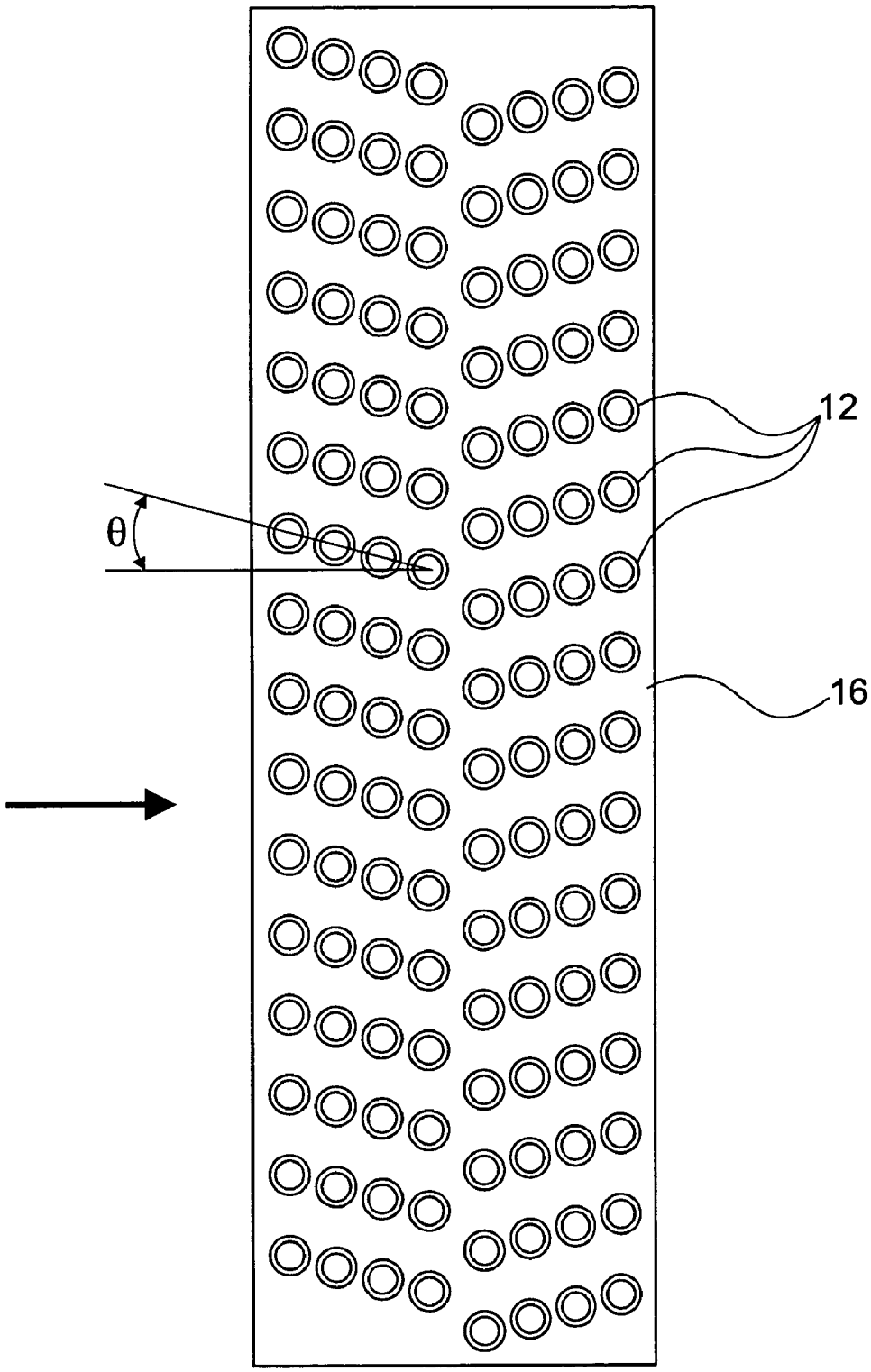
FIG. 2 shows a cross-section of the charge air cooler with the tubes in an arrangement according to another embodiment of the invention.
Figure 3:
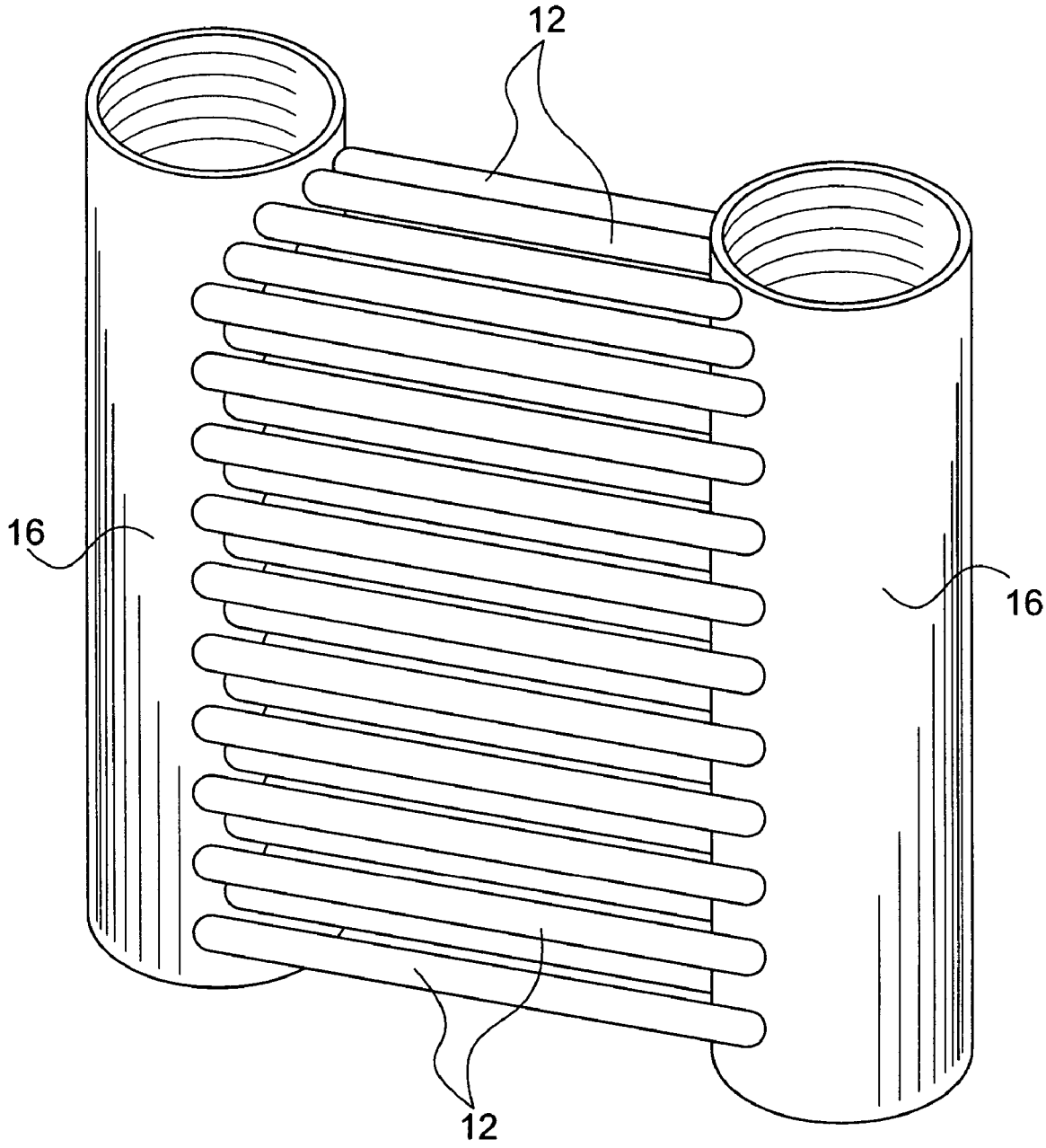
FIG. 3 shows a perspective view of the charge air cooler with the tube arrangement of FIG. 2.

A typical angle θ to the airflow is about 15 degrees, but the angle θ could be about 10 to about 30 degrees to the airflow (i.e., horizontal). In FIG. 2, four tubes 12 are shown at alternating 15 degree angles. FIG. 2 shows an offset pattern of the alternating tubes 12. In this configuration, the incoming ambient air intersects the center of the second alternating row of tubes 12, increasing heat transfer. This configuration also increases the pressure drop. FIG. 3 shows the tubes 12 shows a perspective view of this configuration. The perspective view also shows the tubes 12 mechanically joined to the manifolds 16.

The tube pattern includes a number of tubes placed in straight rows at alternating angles to the incoming ambient air direction. The geometric configuration of the tubes of the charge air cooler of the present invention permits the system to be about 20% more efficient than prior art systems with in-line or staggered tube arrangement.

Figure 4:
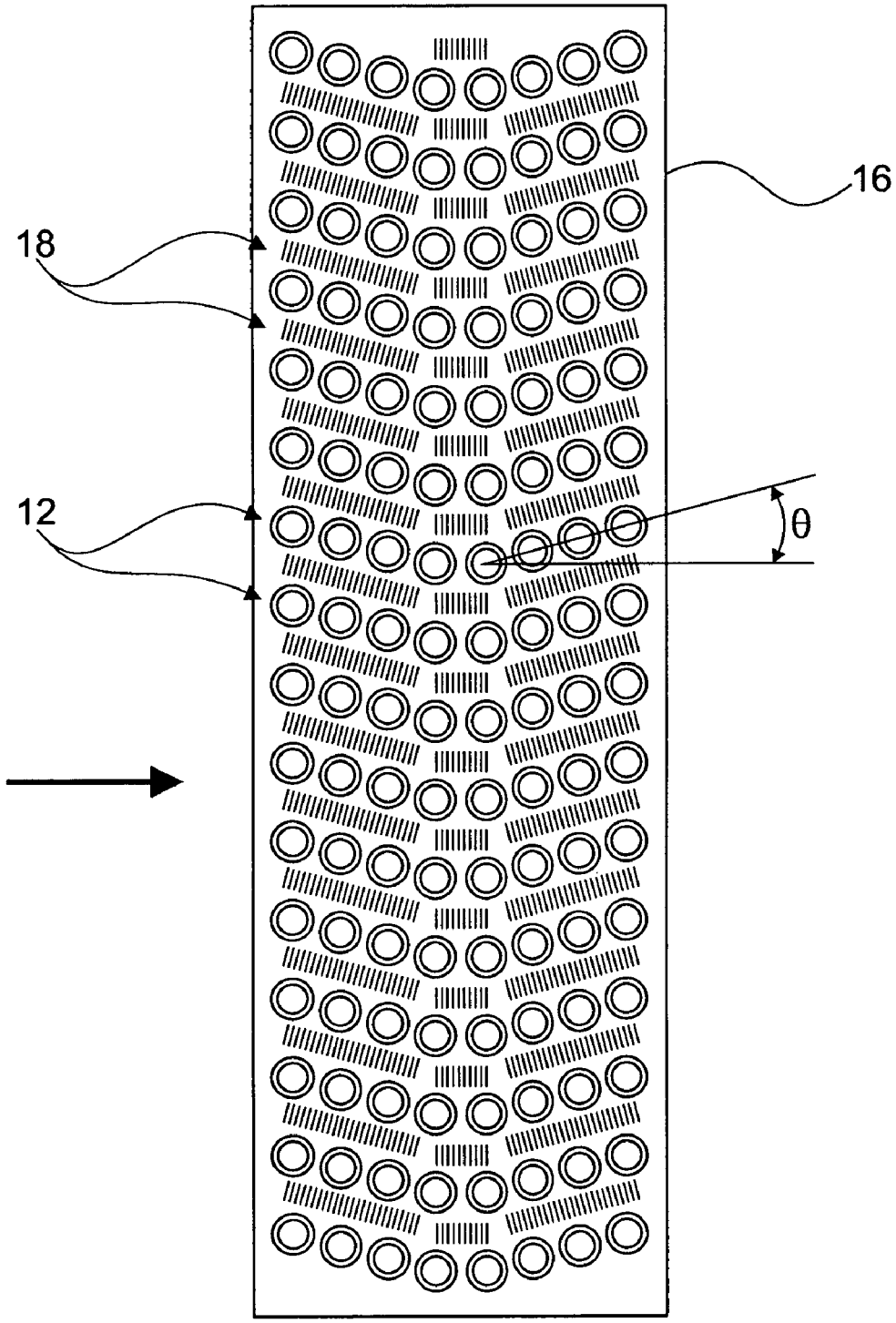
FIG. 4 shows a cross-section of the charge air cooler with the optional external fins on the outside of the tubes.

If additional heat transfer is required, louvered plate-fins 18 can be added to the outside surface of the tube bundle, as shown in FIG. 4. Such fins are typically spaced at about 10 fins per inch, but can be spaced closer or farther depending on the heat transfer desired, the weight of the system, and the overall cost. Such fins are very thin, on the order of about 0.025 mm to about 0.1 mm, with a typical fin having a thickness of about 0.05 mm.

The manifolds 16 are typically cylindrically shaped to withstand the high pressure of the system, as shown in FIG. 3. A manifold 16 at each end of the heat exchanger accommodates all of the tubes 12. The manifolds 16 may be constructed of copper or copper alloy or stainless steel composition pipe or the construction may use two half-circles brazed together after assembly to the tubes 12.

The tubes 12 are formed as a single piece, or they may be welded at the seam. The tubes are preferably mechanically joined or brazed to the manifolds to avoid failure at the joints. This will permit charge air coolers with long life under conditions of frequent thermal and pressure cycling. When the tubes are mechanically joined to the manifold, they are fit with a pressure fit. The manifold includes holes that are slightly smaller than the outer diameter of the tubes. The tubes are then force fit into the holes by pressure, which permits a tight fit and does not require brazing. Alternatively, the tubes could be welded to the manifold.

Preferably, the materials used to form the tubes, the joint, and the manifold have similar hardness. This configuration where the tubes are mechanically joined to the manifolds allows the system to experience temperatures well over about 300° C., and even greater than about 600° C. The upper limit for the system would about 1000° C., where the copper alloys used to form the tubes and manifolds may begin to melt.

Alternatively, when using the two half-circle manifold design, the tubes may be mechanically expanded into the manifolds for a tight joint. When a single pipe manifold is used, holes with a slight interference fit can be used for a mechanical joint to the tubes or the tubes may be brazed to the manifolds. The manifolds are typically capped at one end and a 90 degree elbow is connected to the opposite end.

The charge air cooler of the present invention is capable of withstanding operating pressures over about 3 bars, preferably over about 10 bars, and more preferably up to about 40 bars, at temperatures above about 250° C., preferably above about 300° C. The construction is less expensive than prior art technology. The different geometrical arrangements of the tubes maximizes the efficiency of the system, while the optional louvered fins further enhance heat transfer. The use of the tubes and manifolds of the same alloy joined mechanically extends the life of the unit considerably over the prior art materials and joining methods.

It is to be understood that the invention is not to be limited to the exact configuration as illustrated and described herein. Accordingly, all expedient modifications readily attainable by one of ordinary skill in the art from the disclosure set forth herein, or by routine experimentation therefrom, are deemed to be within the spirit and scope of the invention as defined by the appended claims.

What is claimed is:

1. A charge air cooler for cooling a first gas having a first temperature and that passes through heat transfer tubes by flowing a second gas having a second temperature over the surface of the tubes, wherein the first gas temperature is different than the second gas temperature, the cooler comprising:

plural rows of heat exchange tubes formed of copper or a copper alloy that have a substantially round cross-section, with the first gas passing through the tubes, and with some of the rows being arranged in a first configuration which allows the second gas to flow in a first direction and other rows being arranged in a second configuration where the second gas must change direction to continue to flow past the rows of tubes, with each row forming an angle of about 10 to about 30 degrees with respect to a horizontal center line of the charge air cooler; and first and second manifolds that have substantially round cross-sections in fluid communication with the tubes and being located at each end of the plurality of rows of the tubes, such that each end of each tube is connected to one of the manifolds, wherein the cooler can withstand operation at pressures greater than about 3 bars and temperatures greater than about 250° C.

2. The charge air cooler of claim 1, wherein each row of heat exchange tubes is parallel to an adjacent row.

3. The charge air cooler of claim 1, wherein the first and second configurations of the rows of heat exchange tubes are offset with respect to each other, such that the rows in the first configuration are located above the rows of the second configuration.

4. The charge air cooler of claim 3, wherein the heat exchange tubes are arranged symmetrically between the manifolds.

5. The charge air cooler of claim 1, wherein the heat exchange tubes are mechanically connected to the manifolds without allowing appreciable loss or escape of the first gas from the tubes.

6. The charge air cooler of claim 1, wherein the heat exchange tubes include fins on their outer surfaces.

7. The charge air cooler of claim 1, wherein the heat exchange tubes include grooves on their interior surfaces.

8. The charge air cooler of claim 7, wherein the grooves are helical in shape and extend lengthwise along the tubes.

9. The charge air cooler of claim 1, wherein the heat exchange tubes and manifolds can withstand pressures up to about 40 bars and temperatures up to about 600° C.

10. The charge air cooler of claim 1 wherein the first gas temperature is greater than the second gas temperature, so that the second gas cools the first gas.

11. The charge air cooler of claim 1 wherein the manifolds are formed of copper, a copper alloy or stainless steel.

12. A charge air cooler for cooling a first gas having a first temperature and that passes through heat transfer tubes by flowing a second gas having a second temperature over the surface of the tubes, wherein the first gas temperature is different than the second gas temperature, the cooler comprising:

plural rows of heat exchange tubes formed of copper or a copper alloy that have a substantially round cross-section, with the first gas passing through the tubes, and with some of the rows being arranged in a first configuration which allows the second gas to flow in a first direction and other rows being arranged in a second configuration where the second gas must change direction to continue to flow past the rows of tubes, with each row forming an angle of about 10 to about 30 degrees with respect to a horizontal center line of the charge air cooler, and the first and second configurations are symmetrical; and first and second manifolds that have substantially round cross-sections in fluid communication with the tubes and being located at each end of the plurality of rows of the tubes, such that each end of each tube is connected to one of the manifolds, wherein the cooler can withstand operation at pressures of about 3 to about 40 bars and temperatures of about 250° C. to about 600° C.

13. The charge air cooler of claim 12, wherein the heat exchange tubes include fins on their outer surfaces.

14. The charge air cooler of claim 12, wherein the heat exchange tubes include grooves on their interior surfaces.

15. The charge air cooler of claim 14, wherein the grooves are helical in shape and extend lengthwise along the tubes.

16. The charge air cooler of claim 12, wherein the heat exchange tubes are mechanically connected to the manifolds without allowing appreciable loss or escape of the first gas from the tubes.

17. The charge air cooler of claim 12, wherein the first gas temperature is greater than the second gas temperature, so that the second gas cools the first gas.

18. The charge air cooler of claim 12, wherein the manifolds are formed of copper or a copper alloy or stainless steel.

* * * * *